United States Patent [19]

Burke et al.

[11] 4,326,463

[45] Apr. 27, 1982

[54] DYE MARKER ASSEMBLY FOR ROCKET PRACTICE ROUND

[75] Inventors: Leonard F. Burke, Fallston; Arthur P. Dean, Glen Arm, both of Md.

[73] Assignee: The United States of America as represented by the Secretary of the Army, Washington, D.C.

[21] Appl. No.: 153,469

[22] Filed: May 27, 1980

[51] Int. Cl.[3] ..... F42B 11/16

[52] U.S. Cl. ..... 102/513; 102/529

[58] Field of Search ..... 102/513, 395, 498, 529; 285/415, 414, 388, 321, 305

[56] References Cited

U.S. PATENT DOCUMENTS

| | | | |
|---|---|---|---|
| 1,075,391 | 10/1913 | Weeser | 102/513 |
| 2,907,590 | 10/1959 | Oswald | 285/415 X |
| 3,085,820 | 4/1963 | Pollia | 285/415 X |
| 3,440,963 | 4/1969 | DeLuca | 102/513 |
| 3,645,208 | 2/1972 | Weinssen | 102/513 |
| 3,782,286 | 1/1974 | Jones et al. | 102/513 |

*Primary Examiner*—Harold J. Tudor

*Attorney, Agent, or Firm*—Nathan Edelberg; Robert P. Gibson; A. Victor Erkkila

[57] ABSTRACT

A rocket training round is disclosed to utilize a frangible nose cone containing dye marker material. Upon impact at a target the nose cone breaks thus releasing the dye marker which creates a dye cloud visible within a range of 3,000 meters.

1 Claim, 4 Drawing Figures

DYE MARKER ASSEMBLY FOR ROCKET PRACTICE ROUND

STATEMENT OF GOVERNMENT INTEREST

The invention described herein may be manufactured, used and licensed by or for Governmental purposes without the payment to us of any royalties thereon.

BACKGROUND OF THE INVENTION

The rocket is a self-propelled military weapon capable of being fired from a variety of vehicles and locations. It is commonly utilized in connection with a helicopter as a launching platform. Rockets may be mounted proximate to the under-belly of the helicopter fuselage in pods. Each pod contains a plurality of rockets and there may be one or more pods mounted on the helicopter. With respect to use in conjunction with helicopters, the rocket size is commonly a 2.75 inch.

The fire central mechanism for a rocket is initiated by the helicopter pilot/gunner from his position in the cockpit of the helicopter. The firing configuration permits the pilot to fire one or more rockets as desired.

The rocket as used in conjunction with a helicopter is designed for and is particularly effective against buildings, vehicles and personnel. However, the accuracy of a rocket round is dependent upon a variety of factors. It is fired from a helicopter in flight toward an object or target on the ground which may or may not be in motion. Once fired toward a target which may be a considerable distance from the helicopter, the rocket is subject to variable wind currents and gusts.

As is well recognized by those skilled in these arts, the accuracy and therefore the effectiveness of the rockets against opposing forces is highly dependent upon the experience and training of the pilot/gunner. Training pilot/gunners, however, has presented those concerned with these activities with a plurality of problems. Not the least of such problems has been the difficulty involved in sighting the point of impact of a rocket during a training firing.

In actual combat conditions a rocket comprises a rocket motor as a propulsion means and a warhead filled with explosive material and designed to detonate upon impact. In training, however, it is not always permissible or practical to fire live rounds. Rather, for purposes of training, it has been customary to remove the live warhead portion of the rocket and replace it with an inert steel nose section.

Although the inert steel nose section reproduces the aerodynamic and weight effect on the rocket performance when fired, the only evidence of impact and hence accuracy of the aim is a puff of dirt. Frequently the puff can not be seen by the pilot/gunner as a result of the speed of the helicopter, the angle of attack, the ground conditions (e.g. heavy foilage) and weather conditions. If the impact point can not be seen by the pilot/gunner, then he is unable to evaluate the accuracy of his aim and the purpose of the training is thus frustrated. Additionally, the inability to obtain full benefit of training does not result in development of the necessary experience to build confidence in the weapons system, which confidence is vital and necessary in actual combat conditions.

SUMMARY OF THE INVENTION

It is an object of the present invention, therefore, to provide a training rocket with means for rendering its impact point readily identifiable by the person who launched the rocket, even under adverse conditions.

A further object of the present invention is to provide such a training rocket which is inexpensive to manufacture.

Yet another object of the present invention is to provide a warhead for a training rocket, which warhead clearly marks the point of impact of the rocket.

These objects and others not enumerated are achieved by the training rocket of the present invention, one embodiment of which may include a rocket motor and a training warhead therefor, the training warhead comprising a frangible plastic nose section filled with a red dye powder and removably secured to the rocket motor such that the aerodynamics of the training rocket are not adversely affected and, upon impact, the frangible nose section will shatter to create a cloud of red dust easily viewable from a distance of at least 3,000 meters.

BRIEF DESCRIPTION OF THE DRAWINGS

A more complete understanding of the present invention may be had from the following detailed description thereof, particularly when read in view of the accompanying drawings, wherein.

DETAILED DESCRIPTION

As noted above, the present invention relates to a training rocket. More specifically, the present invention relates to a practice warhead for use with a standard rocket motor, the warhead including a dye filled nose cone which shatters on impact thus causing a cloud of dye to occur thus marking the point of impact.

Figure 1:
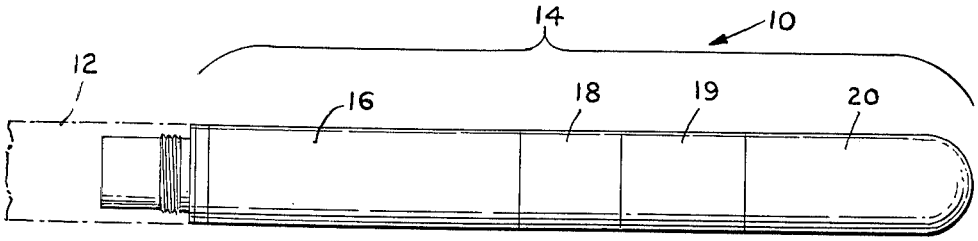
FIG. 1 is a side elevational view of a training rocket warhead structured in accordance with the present invention.

Referring therefore to the drawings, a training rocket structured in accordance with the teaching of the present invention is shown in FIG. 1 and designated generally by the reference numeral 10. Rocket 10, for purposes of this detailed description, is a training version of a 2.75 inch rocket.

Rocket 10 can be seen to include a motor section 12 and a warhead section 14. Motor section 12 is shown in phantom line in FIG. 1 and comprises a standard rocket motor which may be threadedly secured to the warhead section 14 in the conventional manner.

Warhead section 14 comprises a fuselage section 16, a first retainer unit 18, a second retainer unit 19 and a nose cone section 20. Fuselage section 16 is a standard inert steel warhead component from a 2.75 inch rocket training round. The remaining sections, however, are unique to the present invention.

Figure 2:
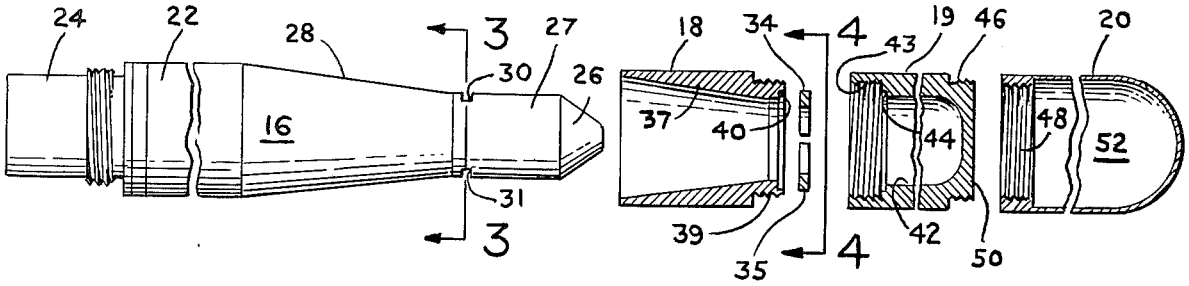
FIG. 2 is an exploded view, partly in cross-section, of the training rocket warhead of FIG. 1.

Referring therefore to FIG. 2, fuselage section 16 can be seen to comprise a generally cylindrical longitudinally extending body 22 having a motor connector end and a nose cone connector end. The motor connector end includes a relieved section 24 having external threads formed thereon for threadedly receiving motor section 12 in the conventional manner.

The warhead connector end of fuselage 16 includes a frustoconical section 26 and a cylindrical section 27. Frusto-conical section 26 is at the forward extremity of fuselage 16 and tapers forwardly from a base diameter which is equal to the diameter of cylindrical section 27. The diameter of cylindrical section 27 is somewhat less, e.g. 1.813 inches, than the basic diameter, 2.75 inches of the fuselage body 22. Thus, the body is provided with a conical section 28 which defines a gradual interface between the main body and cylindrical section 27.

Figure 3:
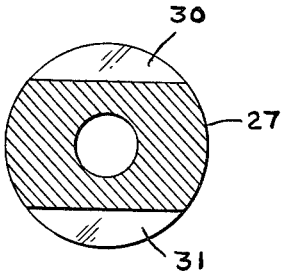
FIG. 3 is a cross-sectional elevational view through the plane 3—3 of FIG. 2.

As best may be seen in FIGS. 2 and 3, the cylindrical nose portion of fuselage 16 is provided with opposed flat slots 30 and 31 which may be formed in the structure by suitable known machining techniques. Slots 30, 31 simulate such slots in a fuse.

Figure 4:
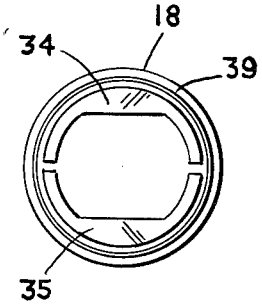
FIG. 4 is an elevational view through the plane 4—4 of FIG. 2.

Slots 30, 31 are provided to receive therein the porions 34, 35 of a split ring (FIG. 4). The split ring functions to cooperate with first and second retainer units 18 and 19 to define a means for securing the nose cone section 20 to the fuselage section 16.

First retainer unit 18 is a generally cylindrical member having a tapered bore 37 the taper of which conforms to the taper of conical section 28 of body 22. The outer diameter of first retainer unit 18 is equal to the outer diameter of body 22 so that when the parts are assembled they cooperate to define a smooth outer surface. The forward end of the outer surface of unit 18 is relieved to defined a threaded annular channel 39. The forward inner surface of unit 18 is relieved to define an annular channel 40 which is provided to receive therein split ring portions 34 and 35.

Second retainer unit 19 is a generally cylindrical member the outer surface of which has a diameter equal to the diameter of body 22. Unit 19 is provided with a longitudinally axial bore 42 which extends from its rearward end throughout almost the entire length of the unit. Formed in bore 42 adjacent its rearward end is a threaded counterbore 43 which is designed for threaded engagement with threaded channel 39 of first retainer unit 18. The interface between bore 42 and threaded counterbore 43 is relieved to define an annular channel 44 the diameter of which is equal to the diameter of annular channel 40 of first retainer unit 18.

The forward outer surface of second retainer unit 19 is relieved to define a threaded annular channel 46. As is discussed below in detail, threaded channel 46 defines the male portion of a threaded connection between second retainer unit 19 and nose cone 20.

Nose cone section 20 comprises a generally cylindrical element being open at its rearward end and closed by a hemispherical closure at its forward end. The basic diameter of the cylindrical portion of section 20 is equal to that of second retainer unit 19. Rigidly secured within the cylindrical section of nose cone 20 is a ring 48 which is provided with internal threads. Threaded ring 48 is sized to be threadedly received on threaded annular channel 46 to rigidly secure nose cone 20 to second retainer unit 19. In this regard, when nose cone 20 is threadedly engaged to second retainer unit 19, the interior of the nose cone cooperates with the forward surface 50 of second retainer unit 19 to define a cavity 52 for retaining the dye powder which is provided to mark the impact point of the rocket during training.

Considering assembly of the warhead section 14 of rocket 10, first retainer unit 18 is positioned over fuselage 16 such that the surface of tapered bore 37 is in contact with the surface of conical section 28. Split rings 34 and 35 are then positioned within slots 30, 31 and, thus, partially into annular channel 40.

Second retainer unit 19 is then slidably introduced over cylindrical portion 27 of fuselage 16 and threadedly engaged to threaded annular channel 39. During this engagement the remaining portions of split rings 34, 35 are received within annular channel 44. Thus, annular channels 40 and 44 of first and second retainer units 18, 19 respectively, cooperate to define a radially outwardly extending annular channel for receiving split rings 34 and 35. The split rings are thus precluded from radial outward displacement from slots 30, 31 by the retainer units while at the same time they cooperate with the retainer units and fuselage 16 to preclude relative longitudinal movement therebetween.

With the warhead thus partially assembled, nose cone 20 is positioned such that its open end extends upwardly and cavity 52 is then filled with a suitable dye marker. Thereafter the partially assembled warhead is threadedly connected to the filled nose cone 20 by threadedly engaging threaded annular channel 46 within threaded ring 48.

Because the diameters of body 22, first and second retainer units 18, 19 and nose cone 20 are all identical, the outer cylindrical surface of the assembled warhead is smooth.

The components of warhead 14 may be manufactured using known techniques and materials. It has been found, however, that satisfactory results are achieved when retainer units 18, 19 and nose cone 20 are manufactured from plexiglas or equivalent frangible material. Known dye markers may be utilized as charges for the nose cone.

Although the present invention has been disclosed in the context of a 2.75 inch rocket warhead, it will be recognized that the technique is equally as applicable to other size rockets. Further, many modifications and variations can be made to the disclosed preferred embodiment without departing from the spirit and scope of this invention.

What is claimed is:

1. A training warhead for a training rocket assembly comprising:

a warhead fuselage including at least one slot formed in a surface of said warhead fuselage, a conical section rearward of said at least one slot, and a cylindrical section forward of said slot;

a nose cone section made of a frangible material and defining a cavity for receiving therein dye marker means, and means for securing said nose cone section to said fuselage comprising a first retainer unit and a second retainer unit, said first retainer unit having a tapered bore conforming to the taper of the conical section of said fuselage and said second retainer unit containing a bore conforming to said cylindrical fuselage section forward of said slot, said first and second retainer units being threadedly engaged and cooperating to define an interior annular channel, said annular channel and said at least one slot cooperating to define a cavity within which to receive a split ring, said split ring for precluding relative longitudinal movement between said means for securing said nose cone section to said fuselage, wherein said fuselage, said nose cone section and said means for securing said nose cone section to said fuselage are all generally cylindrical in configuration and have substantially identical outside diameters.

* * * * *